United States Patent [19]

Ishimori et al.

[11] 4,085,010

[45] Apr. 18, 1978

[54] PROCESS FOR POWDER-DISPERSED COMPOSITE PLATING

[75] Inventors: Shigeru Ishimori, Hamanagun; Shinichi Honda, Hamamatsu, both of Japan

[73] Assignee: Suzuki Motor Company Limited, Japan

[21] Appl. No.: 646,364

[22] Filed: Jan. 2, 1976

Related U.S. Application Data

[63] Continuation of Ser. No. 435,488, Jan. 22, 1974, abandoned.

[51] Int. Cl.[2] ..... C25D 3/00; C25D 5/00; C25D 15/00; C25D 15/02

[52] U.S. Cl. ..... 204/16; 204/237; 204/272; 204/275

[58] Field of Search ..... 204/25, 26, 237, 16, 204/238, 272, 275

[56] References Cited

U.S. PATENT DOCUMENTS

| | | | |
|---|---|---|---|
| 2,431,949 | 12/1947 | Martz | 204/235 |
| 2,484,068 | 10/1949 | Booe | 204/225 |
| 3,061,525 | 10/1962 | Grazen | 204/16 |
| 3,922,208 | 11/1975 | Cordone et al. | 204/272 |

FOREIGN PATENT DOCUMENTS

| | | | |
|---|---|---|---|
| 1,218,179 | 1/1971 | United Kingdom | 204/16 |

*Primary Examiner*—T. M. Tufariello
*Attorney, Agent, or Firm*—Joseph P. Gastel

[57] ABSTRACT

A process and an apparatus for powder-dispersed composite plating in which a plating solution is recycled while a pulverulent material contained is being uniformly dispersed therein, and a plating tank is located in the recycling circuit, so that a uniform composite-plated coating is formed on an object or objects to be plated, while the consumption and dilution of the ions in the bath are being avoided by the constant renewal of the plating solution due to the recycling. This arrangement permits attainment of the highest possible plating efficiency through the use of an increased current density. Moreover, the particle size and concentration of the pulverulent material mixed in the plating solution can be controlled and thereby improvements in both plating quality and productivity can be achieved. In the case where the objects to be plated are cylinder- or ring-shaped or flat pieces, they can be stacked up in a cylindrical formation and compositely plated altogether to attain a remarkably high productivity.

175 Claims, 5 Drawing Figures

PROCESS FOR POWDER-DISPERSED COMPOSITE PLATING

This is a continuation, of application Ser. No. 435,488 filed on Jan. 22, 1974 now abandoned.

This invention relates to a process for powder-dispersed composite plating whereby electroplating is accomplished with an ordinary metal plating bath in which electrically nonconductive powder is dispersed so as to form a plated coating that contains the powder, and to an apparatus therefor.

Dispersion of silicon carbide (SiC) particles, for example, in the deposit of nickel formed by electroplating improves the wear resistance of the resulting surface and is desirable for the finishing of the inner surface of cylinders of internal-combustion engines. Such electroplating is attained by uniformly dispersing the SiC powder in the nickel plating bath, immersing an object to be plated as a cathode, opposite to a nickel rod as an anode, into the bath, and then allowing a suitable current to flow through those electrodes. (For details refer to Japanese Patent Publication No. 3806/1961.)

In the electroplating, the plating bath must at all times contain the powder in a thoroughly dispersed state; otherwise no uniformly plated coating will result. Attempts have, therefore, been made to ensure the thorough dispersion in a number of ways. The methods so far proposed include mechanical agitation of the plating bath, vibration of the object to be plated, and agitation of the bath with bubbles of air issuing from a multiplicity of holes formed in air pipes laid at the bottom of the plating tank. Of those conventional methods, the mechanical agitation can hardly disperse the powder uniformly through the plating tank because the vessel is usually too broad. Commonly, therefore, the mechanical agitation is combined with the vibration of the object to be plated. The combination method has the disadvantage of low productivity because of a rather large-scale equipment required to cause the vibration.

For these reasons the method of agitating the plating bath with air bubbles has more commonly been adopted. It involves no large equipment nor large initial investment, and can agitate the plating solution uniformly. However, these merits of the air-bubble agitation are offset in some applications by the oxidation of the surface of the base metal to be plated and by the consequent deterioration in plating quality. A further demerit is that the air bubbles oxidize the plating bath itself and therefore induces an unfavorable alteration of the bath composition.

The present invention aims at the elimination of these disadvantages of the conventional methods.

It is an object of this invention to provide a process and an apparatus for powder-dispersed composite plating which comprises circulating a plating solution in which a powdery material is uniformly dispersed, providing a plating tank in the circuit of the plating solution, and allowing a uniform plating layer to develop on a work within the plating bath while the plating solution is being constantly renewed by the recycling through the tank to avoid consumption or dilution of the ions in the bath, with the current density increased to maintain as high a plating efficiency as possible, and also with the particle size and concentration of the pulverulent material, such as SiC, to be mixed in the bath being suitably controllable, so that both the plating quality and productivity can be improved.

Another object of the invention is to provide a process and an apparatus for powder-dispersed composite plating applicable simultaneously to a plurality of cylinder- or ring-shaped objects for a very high productivity in the plating operation.

These and other objects and features of the present invention will become more apparent from the following description taken in connection with the accompanying drawings showing embodiments thereof. In the drawings.

Figure 1:
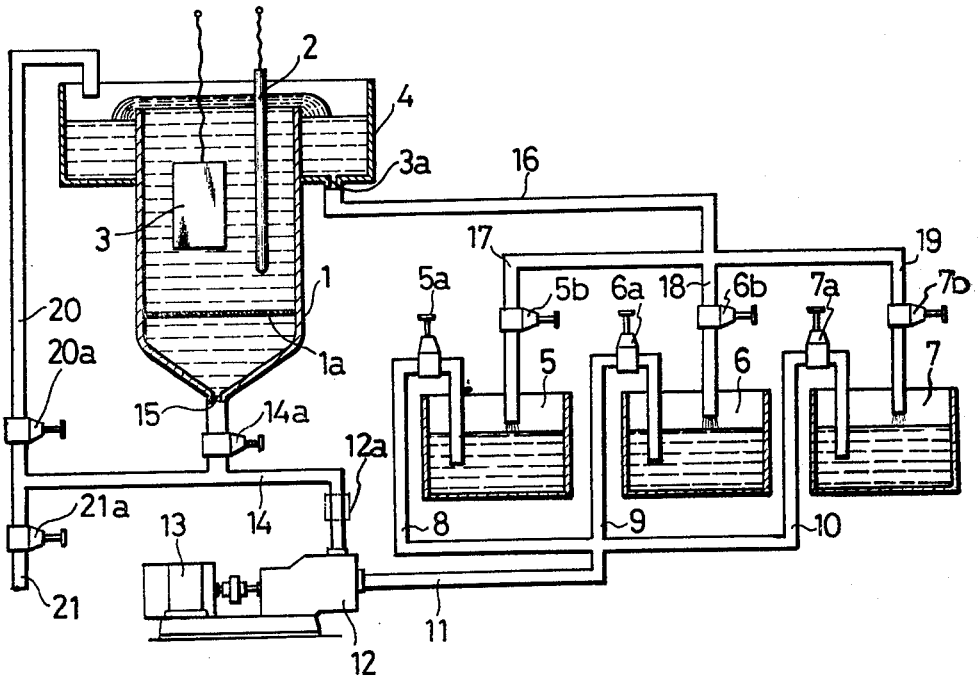
FIG. 1 is a schematic arrangment for the powder-dispersed composite plating according to this invention.

Referring to FIG. 1, there is shown a cylindrical plating tank 1 kept upright. Inside this tank, an anode 2 and an object 3 to be plated are held parallelly upright in a spaced relationship. The object 3 to be plated is electrically connected so that it acts as a cathode. A recycling tank 4 larger in outside diameter than the plating tank 1 is installed liquidtightly around the upper periphery of the tank 1. In the lower part of the plating tank, a screenlike dispersing plate 1*a* is horizontally secured. The dispersing plate 1*a*, a metal screen of stainless steel, serves to disperse the powder in the plating bath to be uniform, fine particles. The useful screen size or mesh ranges from 0.1 to 1.1 cm.

Side by side with the tank are located storage tanks 5, 6, 7, respectively, for pre-nickel-plating solution, composite-plating solution, and washing water. The composite-plating solution in the storage tank 6 contains powder of a very hard material, e.g., silicon carbide (SiC) or tungsten carbide. In addition to such a compound, any other substance useful for the intended application, such as the oxide or carbide of a metal, e.g., aluminum oxide, titanium oxide or titancarbide, which is insoluble in the electrolyte and water, or fine particles of a solid lubricant or organic polymer, e.g., carbon fluoride, fluorocarbon polymer, molybdenum disulfide, or synthetic rubber, may be added to the composite-plating solution.

The fluids from these storage tanks 5, 6, 7 are supplied by prearranged procedure to the bottom opening 15 of the plating tank 1 via lines 8, 9, 10 and 11. Valves 5*a*, 6*a*, 7*a* are installed midway in the lines 8, 9, 10, and numerals 12 and 13 indicate a feed pump and a motor therefor, respectively. The pump 12 is communicated to the bottom opening 15 of the plating tank 1 with line 14, which line in turn is equipped with a valve 14*a*.

Each of the liquids, such as the composite-plating solution fed to the bottom of the plating tank 1, is flown upward and overflown into the recycling tank 4. An opening 3*a* is formed at the bottom of the tank 4, and is connected with a recycling line 16, which in turn is branched into three lines 17, 18, 19 communicating, respectively, to the storage tanks 5, 6, 7. Thus, the overflown liquid is returned to the storage tank 5, 6 or 7. Valves 5*b*, 6*b*, 7*b* are separately installed in the branched lines 17, 18, 19. An auxiliary line 20 and a drain pipe 21 are connected via valves 20*a*, 21*a*. The auxiliary line 20 is located so that the liquid from the pump 12 can be directly supplied to the recycling tank 4.

As means for controlling the flow velocity and flow rate of the plating solution ascending in the plating tank 1, the pump 12 is preferably of variable-delivery type. Where necessary, it is equipped with a flow control valve 12*a*, which may replace the existing valve 14*a*.

Figure 2:
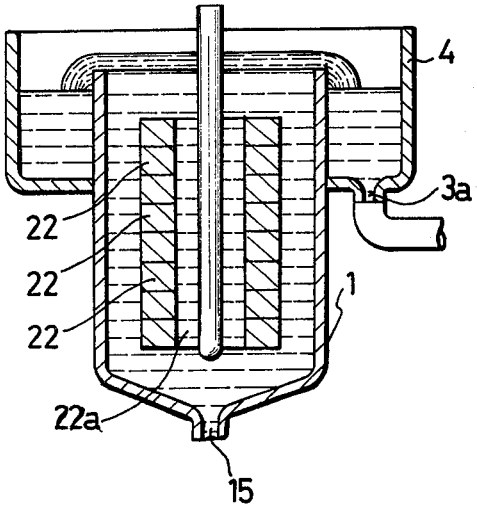
FIGS. 2 and 3 are sectional views of plating baths with cylinder- or ring-shaped objects to be plated in accordance with the invention.

If the object 3 to be plated is a plurality of cylinder- or ring-shaped articles 22 as shown in FIG. 2, they are stacked with their axes aligned as shown. Along the center line of the cylindrical hollow 22*a* thus formed, a long anode 2*a* is vertically inserted and is electrically connected so as to make the articles 22 to be plated as cathodes. In this manner both the inner and outer surfaces of such cylinder- or ring-shaped works 22 can be compositely plated with a high degree of efficiency.

Figure 3:
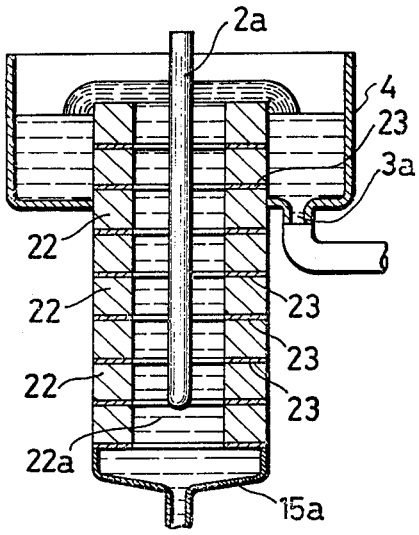

FIG. 3 is a similar sectional view illustrating another embodiment of the invention for efficiently plating cylinder- or ring-shaped articles. Here the articles 22 are centered and stacked alternately with annular packings 23 of an acidproof material such as silicone rubber. Along the center line of the cylindrical hollow 22*a* formed in this way, a long anode 2*a* is vertically suspended. A hopper-shaped bottom member 15*a* to be connected to the line 14 shown in FIG. 1 is liquidtightly secured to the lowermost of the articles 22 in the stack, via the lowermost packing 23. Since the articles 22 to be plated are stacked up in a leakproof way with the packings 23 sandwiched therebetween, the resulting cylinder serves as a plating tank. In this embodiment, therefore, the individual articles 22 are made as cathodes and the inner surfaces can be compositely plated at the same time. This embodiment may be modified so as to handle workpieces in the form of flat plates in addition to or in place of the articles 22.

Figure 4:
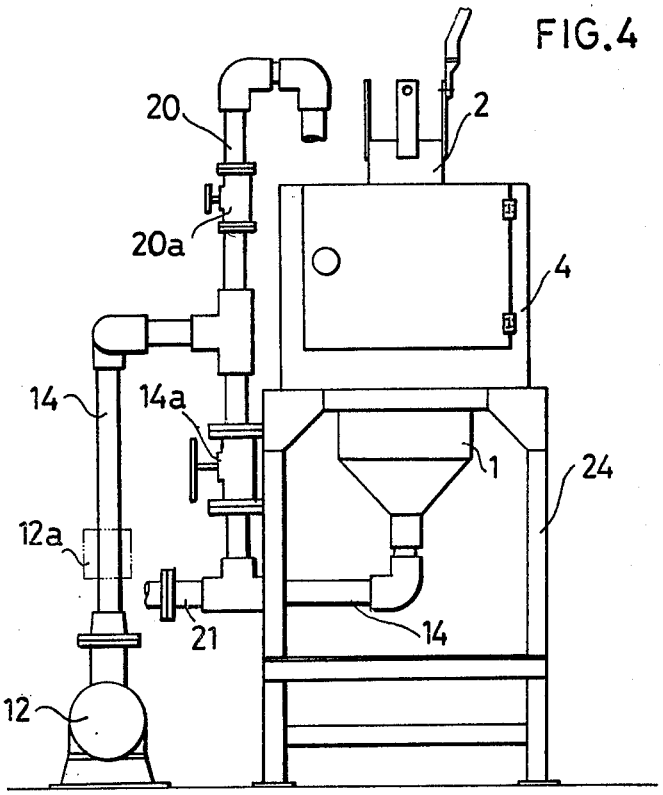
FIGS. 4 and 5 are front and side views, respectively, of a typical installation of a plating tank and a recycling tank.
Figure 5:
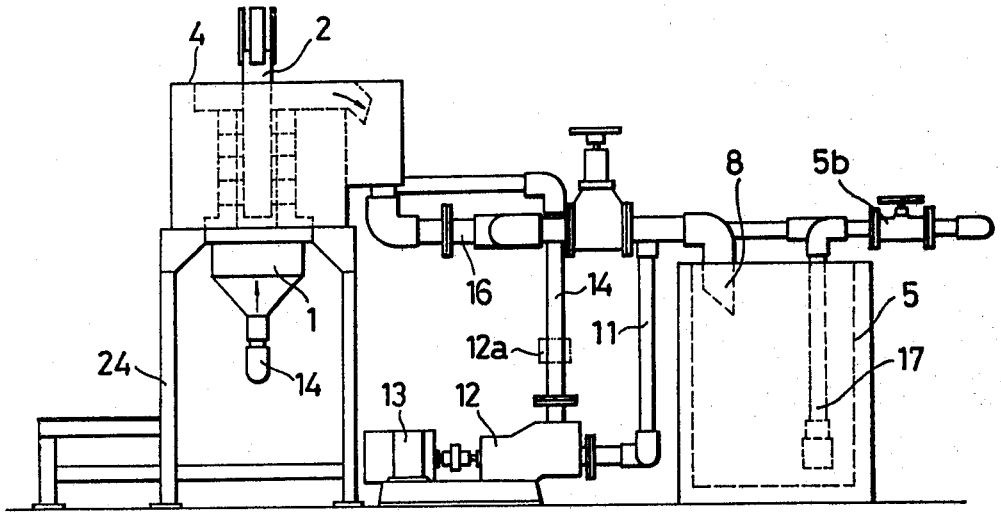

As shown in FIGS. 4 and 5, the plating tank 1 and the recycling tank 4 may be suitably installed on a common supporting frame 24. The anode 2 and the articles 3 to be plated may also be mounted on either the recycling tank 4 or frame 24 via suitable support means (not shown).

Generally electroplating has the disadvantage of a slower plating rate than other processes such as melt plating. In order to increase the plating rate, the use of a high density current must be made possible without any sacrifice of the current efficiency. However, because the bath composition and other operating conditions are in many cases constant, the range of current density that can maintain good plating quality is limited.

It is noted, in this connection, that the critical current density for electroplating is given by the expression $$Ie = \frac{n.F.D.C}{\delta(1-\alpha)} \qquad (1)$$

where $Ie$ = critical current density, A/dm$^2$
$n$ = valence of the plating metal
$F$ = Faraday constant, 96500 coulombs
$D$ = Diffusion coefficient, cm$^2$/sec
$C$ = metal salt concentration, mol/cc
$\delta$ = thickness of the diffusion layer, cm
$\alpha$ = transport number of metal ions If $Ie$ in Eq. (1) is to be increased while the same bath composition is maintained, either D or $\alpha$ must be increased or $\delta$ must be decreased, because $n$, F, C are constants. Although the diffusion coefficient D and ion transport number $\alpha$ can increase with the rise of the bath temperature, the temperature rise has its limit because of the deteriorating effect upon the bath. From this it follows that the thickness $\delta$ of diffusion layer is the only variable that can be controlled.

Assuming that the flow is laminar, the thickness $\delta$ of diffusion layer is $$\delta = 2.91 \times ;12 \frac{(\frac{\nu x}{u})^{\frac{1}{2}}}{(\frac{\nu}{D})^{\frac{1}{3}}} \qquad (2)$$

where $\nu$ = kinetic viscosity, stokes
$x$ = position on the test specimen in the flow direction, cm
$\mu$ = flow velocity of the plating solution, cm/sec
D = diffusion coefficient, cm$^2$/sec If the thickness of the diffusion layer in Eq. (2) is to be decreased, the flow velocity of the plating solution must be considered. Then, in Eq. (2), $\delta = K.u^{-1/2}$ (where $K$ is a constant) and it follows that the flow velocity has only to be increased.

As noted above, it is often the case with electroplating that the bath composition and other operating conditions are predetermined. Sufficient care must, therefore, be taken in modifying those conditions. In order to improve the rate of electrodeposition without an appreciable change in any of those conditions, it is important to perform the plating operation efficiently with a high current density. To raise the current density without affecting the bath composition or any other factor, it is only necessary to increase the flow velocity because, as already noted, Eqs. (1) and (2) when combined given the relation $Ie \propto K.u^{1/2}$ (where K is a constant). In view of this, a variety of ways for increasing the flow rate have been attempted at. For example, so-called jet flow methods for the high-speed, forced supply of a plating solution, and so-called parallel flow methods whereby a plating solution is horizontally flown at a high speed over the work, have been proposed and studied in the art.

The foregoing discussion has been based on the assumption that the flow of the plating solution is laminar. However, the process of the present invention brings just as satisfactory results when the bath is in the region of turbulent flow. This is exemplified by an experiment of composite plating which was conducted with a 60% nickel sulfonate plating solution containing 150 g/l of 0.1 ~ 10$\mu$ silicon carbide powder per liter of the solution in the region of turbulent flow with a Reynolds number Re = 28000 at a flow rate of 60 cm/sec, using a current density of 70 A/dm$^2$. This composition of the composite plating solution is the same as set forth on later page. The results were that the current efficiency achieved was 100%, the silicon carbide content of the plated coating thereby obtained was 5.0%, and the Vickers microhardness of the coating was 580. It was found that a plated coating with a fine appearance could be formed in the way described.

In the composite plating in the region of turbulent flow as well as in the laminar-flow region, the critical current density can be increased by raising the flow velocity of the plating solution. In the case of the turbulent flow, the thickness $\delta$ of the diffusion layer is given by Eq. (3).

$$\delta = 27.8 \times \frac{(\frac{\nu}{u})^{4/5} x^{1/5}}{(\frac{\nu}{D})^{1/3}} \quad (3)$$

From Eqs. (3) and (1), $$Ie = K'.\mu^{4/5}$$

where K' is a constant.

With ordinary plating baths, the jet flow and parallel flow methods appear to present relatively few problems in plating operations. For composite-plating solutions containing materials to be separately and dispersedly precipitated as under the present invention, however, those methods prove disadvantageous because of inadequate agitation and rather uniform distribution of the precipitate.

These problems are totally eliminated by the process of the invention which permits the plating solution to flow upward along a vertical passage. It is then possible to increase the flow velocity and perform high-speed plating.

In the plating with conventional tank arrangements, it has been customary to stir the plating bath or vibrate the object to be plated, as stated earlier, in an effort to realize the high-speed plating through the reduction in the thickness $\delta$ of the diffusion layer. For practical purposes, the maximum current density available is at most several ten amperes per square decimeter. The present invention, by contrast, is characterized by a short distance of 0.2 cm – 10.0 cm between the anode and cathode and a highspeed upward flow at a velocity of 4.2 – 400 cm/sec of the plating solution between and along the electrodes, and hence by the use of a high current density that would be impossible with conventional tank-type plating. Thus, plating is carried out more rapidly than heretofore. Such highspeed plating is feasible both in the laminar- and turbulent- flow regions.

The procedure for composite plating with the use of the apparatus according to the invention will now be explained.

First, all valves are closed and heaters, for example of the immersion type (not shown), are introduced into the storage tank 5 containing the pre-nickel-plating solution and into the tank 6 storing the composite-plating solution. The heaters are switched on to heat the plating solutions in the tanks 5, 6 up to preset temperatures. The temperature settings are preferably 50°± 3° C for the plating solution in the tank 5 and 57°± 3° C for the solution in the tank 6. Next, a pretreated object 3 or 22 to be plated is placed in the plating tank 1. The object to be plated is pretreated in order to help the composite-plated coating to adhere securely to the base surfaces. To this end the pretreatment may be accomplished, for example, by degreasing, acid treatment, or dipping for zinc substitution. The object, if in the form of cylinder- or ring-shaped pieces as shown in FIG. 2 or 3, should be stacked up as shown.

These preparatory steps are followed by pre-nickel plating, or ordinary nickel plating of the work with a plating bath free of hard particles. The plating, herein referred to as pre-nickel-plating, is intended for the same purpose as the pretreatment above described. The composition of the plating bath is: 780 ± 46 g/l of a 60% nickel sulfamate solution, 11.7 ± 0.7 g/l nickel chloride, and 45 ± 5 g/l boric acid. To begin with, the valves 5a, 5b, 14a and 20a are opened and the pump 12 is started to admit the pre-nickel-plating solution into the plating tank 1, from the bottom upward. Next, the valve 20a is reclosed and either the opening of the valve 14a is adjusted or the flow control valve 12a, if provided, is manipulated to properly control the flow velocity of the pre-nickel-plating solution. A desired current preferably 2 – 10A/dm$^2$ is flown through the anode 2 and object 3 or 22 for a predetermined period of time (5 – 20 minutes of time) to effect pre-nickel-plating. After this preplating treatment, the current is shut off and the pump 12 is stopped. Then, the valve 5a is closed and the other valves 14a, 20a, 21a are opened to drain off the residual pre-nickel-plating solution. As a result, a nickel coating about 1 to 20 $\mu$ in thickness and free from hard particles is deposited on the base surface.

Following the pre-nickel-plating, the first rinsing is carried out. The valves 5b, 21a are closed while the valves 7a, 7b are opened, and the pump 12 is started. In this way water is led from the storage tank 7 into the plating tank 1 and recycling tank 4, thus washing the object 3 or 22 to be plated as well as the piping system. After the purification, the pump 12 is stopped, the valve 7a is closed, and the valve 21a is opened to drain off the residual rinsings from the system. Finally the valve 7b is closed.

The next step is composite plating. For this purpose, the valve 21a is closed, the valves 6a, 6b are opened, and the pump is started to cause an upward flow of the composite-plating solution in the plating tank 1. The flow velocity of 4.2 – 400 cm/sec of the composite-plating solution is controlled by closing the valve 20a and either adjusting the opening of the valve 14a or with the use of the flow control valve 12a. The composition of the composite-plating solution used is: 826 ± 46 g/l of a 60% nickel sulfamate solution, 15.1 ± 1.7 g/l nickel chloride, 45 ± 5 g/l boric acid, 2.9 ± 0.7 g/l saccharin sodium, and 150 g/l silicon carbide of 0.1 ~10$\mu$. No organic hardener is employed. With a current density of 15 – 300 A/dm$^2$ applied for a predetermined period of time, the object 3 or 22 is compositely plated. The plated coating thus obtained may range in thickness from about ten to several thousand microns. Usually the coating has a thickness between about 100 and 600 $\mu$. On completion of the plating, the power supply is shut off and the pump 12 is stopped. The valve 6a is closed and the other valves 14a, 20a, 21a are opened to drain off the residual composite-plating solution from the piping system.

The composite plating is followed by second and last rinsing. First, the valves 6b, 21a are closed while other valves 7a, 7b are opened, and the pump 12 is started to admit water into the plating tank 1, recycling tank 4 for thorough purification of the composite-plated article and the piping system. After this last rinsing, the pump 12 is stopped, the valve 7a is closed, and the drain valve 21a is opened to drain off the residual rinsings. Finally the valves 14a, 20a, 7b are closed.

The same procedure applies to the embodiments shown in FIGS. 2 and 3 where a plurality of cylinder- or ring-shaped articles are simultaneously composite-plated.

The product or products finished with the pre-nickel-plating and composite plating in the manner described are then taken out of the apparatus.

Examples of composite plating by the procedure described above are given hereunder.

EXAMPLE

(1) Critical current density

The current density being equal, the higher the flow velocity of a plating solution, the greater the current efficiency will be. This relation is typically represented in Table 1.

Table 1

Relation between the flow velocity of plating solution and current efficiency (current density 20 A/dm$^3$)

| | | | |
|---|---|---|---|
| Flow velocity (cm/sec) | 0.47 | 1.7 | 4.2 |
| Current efficiency (%) | 96 | 97 | 100 |

The current density for attaining 100% current efficiency, or the critical current density, is reached by increasing the flow velocity of the plating solution. Where a high current density is to be used, a correspondingly increased flow velocity is required. Table 2 illustrates this relationship.

Table 2

Relation between critical current density and flow velocity (current efficiency 100%)

| | | | | |
|---|---|---|---|---|
| Critical current density (A/dm$^2$) | 15 | 20 | 25 | 30 |
| Flow velocity (cm/sec) | >4.2 | >4.2 | >6.5 | >9.0 |

As can be seen from Table 2, a current density of as much as 30 A/dm$^2$ may be used if the flow velocity of the plating solution is increased to 9.0 cm/sec or upwards.

(2) Hardness of Composite-Plated Coatings

Hardness of the plated coatings experimentally formed was determined with a Vickers microhardness tester. The hardness of the plated coating according to this invention is not dictated by the flow velocity of the plating solution but by the current density used. This will be obvious from Table 3.

Table 3

Relation between current density and hardness (flow velocity 4.2 cm/sec)

| | | | | |
|---|---|---|---|---|
| Current density (A/dm$^2$) | 15 | 20 | 25 | 30 |
| Hardness (MHv 0.2) | 531 | 559 | 573 | 590 |

Where a current density of 20 A/dm$^2$ is used for conventional tank-type plating, the hardness attained is approximately 550, or the value little different from that obtained in accordance with this invention. However, the hardness of the plated coating formed by the invention depends upon the current density employed, and the hardness can be freely controlled by using a high current density where a plated coating with a high degree of hardness is desired or using a low current where low hardness is needed.

(3) Cathode current efficiency

Cathode current efficiency drops with an increase in current density, which is attributable to the deposition on the cathode of a greenish substance, apparently nickel hydroxide. This drop can be avoided by accelerating the flow of the plating solution. However, the nickel hydroxide or the like that has once deposited on the cathode cannot be removed by increasing the flow velocity at any point during the plating process; a high flow velocity must be used from the very beginning of the plating operation. That is to say, it is important to increase the flow velocity where a high current density is to be used. Stated differently, it means that the use of a high current density is made possible by increasing the flow velocity. This relation is exemplified in Table 4.

Table 4

Effects of flow velocity and current density upon cathode current efficiency

| Cathode current efficiency (%) | Current density (A/dm$^2$) 15 | 20 | 25 | 30 |
|---|---|---|---|---|
| Flow velocity: | | | | |
| 0.47 cm/sec | 97 | 96 | 93 | 88 |
| 4.2 cm/sec | 100 | 100 | 95 | 93 |

(4) Silicon Carbide Contents of Composite-Plated Coatings

Aluminum objects were composite-plated, the plated coatings were stripped away and burnt on a coulombatic carbon tester to determine the carbon contents in the coatings, and then, on the basis of the values so determined, the silicon carbide contents were calculated.

The plating solutions which would give silicon carbide contents of 3 to 4% in the plated coatings by the conventional tank-type plating were employed in the practice of the present invention, and similar results were obtained.

As has been described, this invention permits the use of a higher current density than in conventional processes. The high current density brings a high silicon carbide content in the resulting coating. Therefore, the silicon carbide content of a composite-plated coating can be adjusted through the control of the current density to be used. Table 5 indicates this relationship.

Table 5

Relation between silicon carbide content and current density (flow velocity 4.2 cm/sec)

| | | | | |
|---|---|---|---|---|
| Current density (A/dm$^2$) | 15 | 20 | 25 | 30 |
| SiC content of plated coating (%) | 3.0 | 3.7 | 3.7 | 4.0 |

(5) Dispersibility of Silicon Carbide in Plated Coatings

Composite-plated coatings were embedded in resin, ground and polished with emery and by buffing, and the dispersion of silicon carbide particles in the matrixes was microscopically observed. In test specimens compositely plated with current densities of 20 A/dm$^2$ or less, the distribution of the silicon carbide particles was slightly ununiform as in the ordinary tank-type plating, and some nickel surfaces indicated poor dispersion of the silicon carbide particles.

The composite-plated coatings formed with current densities of 25 A/dm$^2$ or upwards in accordance with this invention showed uniform distribution of the silicon carbide particles in the nickel matrixes. This tendency was all the more pronounced when the dispersion plate la was installed in the lower part of the plating tank 1. When the composite-plating solution is kept still, the smaller the particle size of the silicon carbide, the greater the tendency of the particles to aggregate. In a solution that has been allowed to stand for several days, for example, the silicon carbide particles are in the form of aggregate mass. The dispersion plate la installed in the recycling line for the composite-plating solution serves to disperse the mass uniformly into separate, individual fine particles.

Next, examples of composite plating with fine particles other than those of silicon carbide, i.e., with the fine particles of tungsten carbide, aluminum oxide, titanium dioxide, titanium carbide, carbon fluoride, molybdenum disulfide, and synthetic rubber, will be given below. The experiments were conducted under the conditions which usually permitted the use of current densities exceeding 20 A/dm$^2$. This composite-plating solution used is the same as above mentioned.

(6) Composite Plating with Tungsten Carbide WC

Particle size : 0.1–10 μ
Concentration : 10–150 g/l
Flow velocity : 20–300 cm/sec
Current density : 20–300 A/dm$^2$ (i) Critical Current density As already noted, the current density being equal, the higher the flow velocity of a plating solution, the greater the current efficiency will be. Assuming now that the current efficiency is 100%, its relation with the flow velocity will be as tabulated in Table 6.

Table 6

Relation between critical current density and flow velocity of plating solution (current efficiency 100%)

| Critical current density (A/dm$^2$) | 20 | 25 | 30 |
|---|---|---|---|
| Flow velocity (cm/sec) | >21.8 | >32.0 | >45.0 |

(ii) Hardness of Composite-Plated Coating

Unlike the plating with silicon carbide, an increased current density will not confer a correspondingly increased hardness on the plated coating. This relation is shown in Table 7.

Table 7

Relation between current density and hardness (flow velocity 45 cm/sec)

| Current density (A/dm$^2$) | 20 | 25 | 30 |
|---|---|---|---|
| Hardness (MHv 0.2) | 546 | 550 | 550 |

(iii) Tungsten Carbide Content of Composite-Plated Coating

In the same way as with silicon carbide, the tungsten carbide content of a composite-plated coating tends to increase with a rise of the current density. The relation will be clear from Table 8.

Table 8

Relation between current density and tungsten carbide (WC) content (flow velocity 45 cm/sec)

| Current density (A/dm$^2$) | 20 | 25 | 30 |
|---|---|---|---|
| WC content of plated coating (%) | 3.8 | 4.0 | 4.1 |

(7) Composite Plating with Aluminum Oxide $Al_2O_3$

Particle size : 0.1–10 μ
Concentration : 25–200 g/l
Flow velocity : 6–400 cm/sec
Current density : 20–300 A/dm$^2$ (i) Critical current density An increased flow velocity of a plating solution brings a 100% current efficiency and an increased critical current density. The relations are as indicated in Tables 9 and 10.

Table 9

Relation between flow velocity and current efficiency (current density 20 A/dm$^2$)

| Flow velocity (cm/sec) | 4.2 | 6.1 |
|---|---|---|
| current efficiency (%) | 98 | 100 |

Table 10

Relation between critical current density and flow velocity (current efficiency 100%)

| Critical current density (A/dm$^2$) | 20 | 25 | 30 |
|---|---|---|---|
| Flow velocity (cm/sec) | >6.1 | >9.2 | >13.5 |

(ii) Hardness and Aluminum Oxide Content of Composite-Plated Coating

The higher the current density, the larger the aluminum oxide content of the plated coating, and hence the greater the hardness of the coating will be. These relations will be evident from Table 11.

Table 11

Relations between current density and hardness and $Al_2O_3$ content (flow velocity 13.5 cm/sec)

| Current density (A/dm$^2$) | 20 | 25 | 30 |
|---|---|---|---|
| $Al_2O_3$ content of plated coating (%) | 4.8 | 5.0 | 5.3 |
| Hardness (MHv 0.2) | 550 | 553 | 565 |

(8) Composite Plating with Titanium Dioxide $TiO_2$

Particle size : 0.1–5 μ
Concentration : 10–100 g/l
Flow velocity : 3–300 cm/sec
Current density : 20–300 A/dm$^2$ (i) Critical current density With a current density of 20 A/dm$^2$, the current efficiency will be 100% if the flow velocity is in excess of 3.5 cm/sec. A higher flow velocity will be accompanied by a greater critical current density. These relations are given in Tables 12 and 13.

Table 12

Relation between flow velocity and current efficiency (current density 20 A/dm$^2$)

| Flow velocity (cm/sec) | 1.2 | 3.5 |
|---|---|---|
| current efficiency (%) | 96 | 100 |

Table 13

Relation between critical current density and flow velocity (current efficiency 100%)

| Critical current density (A/dm$^2$) | 20 | 25 | 30 |
|---|---|---|---|
| Flow velocity (cm/sec) | >3.5 | >5.2 | >7.5 |

(ii) Hardness and Titanium Dioxide Content of Composite-Plated Coating

An increase of the current density will not be accompanied by an increased titanium dioxide content or hardness. The relationship will be understood from Table 14.

Table 14

| Relation between current density and hardness and $TiO_2$ content (flow velocity 7.5 cm/sec) | | | |
|---|---|---|---|
| Current density ($A/dm^2$) | 20 | 25 | 30 |
| $TiO_2$ content of plated coating (%) | 2.3 | 2.1 | 2.3 |
| Hardness (MHv 0.2) | 520 | 516 | 518 |

(9) Composite Plating with Titanium Carbide TiC

Particle size : 0.1–10 μ
Concentration : 10–100 g/l
Flow velocity : 7–500 cm/sec
Current density : 20–300 $A/dm^2$ (i) Critical Current Density With a current density of 20 $A/dm^2$, a flow velocity of 7.2 cm/sec will give a 100% current efficiency. The relation between the flow velocity and critical current density will be obvious from Table 15.

Table 15

| Relation between critical current density and flow velocity (current efficiency 100%) | | | |
|---|---|---|---|
| Critical current density ($A/dm^2$) | 20 | 25 | 30 |
| Flow velocity (cm/sec) | >7.2 | >11.0 | >15.6 |

(ii) Hardness and Titanium Carbide Content of Composite-Plated Coating

An increase of the current density will be accompanied by an increase in the titanium carbide content and hence in the hardness of the resulting coating. This relation will be clear from Table 16.

Table 16

| Relation between current density and hardness and TiC content (flow velocity 15.6 cm/sec) | | | |
|---|---|---|---|
| Current density ($A/dm^2$) | 20 | 25 | 30 |
| TiC content of plated coating (%) | 33.66 | 4.0 | 4.2 |
| Hardness (MHv 0.2) | 565 | 568 | 580 |

(10) Composite Plating with Carbon Fluoride $(CF)_n$

Particle size : 0.1–15 μ
Concentration : 2–60 g/l
Flow velocity : 2–1000 cm/sec
Current density : 20–200 $A/dm^2$ (i) Critical Current Density The relations between the flow velocity and current efficiency and between the flow velocity and critical current density are as given in Tables 17 and 18. If the critical current density is to be increased, it is only necessary to use a higher flow velocity.

Table 17

| Relation between flow velocity and current efficiency (current density 20 $A/dm^2$) | | |
|---|---|---|
| Flow velocity (cm/sec) | 0.62 | 2.8 |
| Current efficiency (%) | 99 | 100 |

Table 18

| Relation between critical current density and flow velocity (current efficiency 100%) | | | |
|---|---|---|---|
| Critical current density ($A/dm^2$) | 20 | 25 | 30 |

Table 18-continued

| Relation between critical current density and flow velocity (current efficiency 100%) | | | |
|---|---|---|---|
| Flow velocity (cm/sec) | >2.8 | >4.1 | >6.0 |

(ii) Hardness and Carbon Fluoride Content of Composite-Plated Coating

An increased current density will not be accompanied by an increased carbon fluoride content; rather the $(CF)_n$ content tends to decrease slightly. Similarly, the hardness shows a slight decrease. This relation is shown in Table 19.

Table 19

| Hardness and (CF)n content of composite-plated coating (flow velocity 6 cm/sec) | | | |
|---|---|---|---|
| Current density ($A/dm^2$) | 20 | 25 | 30 |
| (CF)n content of plated coating (%) | 2.4 | 2.4 | 2.1 |
| Hardness (MHv 0.1) | 535 | 523 | 525 |

(11) Composite plating with molybdenum disulfide $MoS_2$

Particle size : 0.1–10 μ
Concentration : 10–100 g/l
Flow velocity : 7–400 cm/sec
Current density : 20–300 $A/dm^2$ (i) Critical Current Density The relations between the flow velocity and current efficiency and between the flow velocity and critical current density are shown in Tables 20 and 21. In brief, the higher the flow velocity, the greater the critical current density.

Table 20

| Relation between flow velocity and current efficiency (current density 20 $A/dm^2$) | | |
|---|---|---|
| Flow velocity (cm/sec) | 5.2 | 7.6 |
| Current efficiency (%) | 97 | 100 |

Table 21

| Relation between critical current density and flow velocity (current efficiency 100%) | | | |
|---|---|---|---|
| Critical current density ($A/dm^2$) | 20 | 25 | 30 |
| Flow velocity (cm/sec) | >7.6 | >11.5 | >16.9 |

(ii) Hardness and Molybdenum Disulfide Content of Composite-Plated Coating

The hardness and the molybdenum disulfide content of the composite-plated coating are not influenced by the density of the current applied. These relations are indicated in Table 22.

Table 22

| Hardness and $MoS_2$ content of composite-plated coating (flow velocity 16.9 cm/sec) | | | |
|---|---|---|---|
| Current density ($A/dm^2$) | 20 | 25 | 30 |
| $MoS_2$ content of plated coating (%) | 3.2 | 3.5 | 3.5 |
| Hardness (MHv 0.2) | 526 | 518 | 520 |

(12) Composite Plating with Synthetic Rubber SBR Latex*

*Butadiene-styrene rubber

Particle size : 0.01–0.3 μ
Concentration : 1–100 g/l
Flow velocity : 2–200 cm/sec
Current density : 20–300 A/dm²

(i) Critical Current Density

A 100% current efficiency is achieved with a low flow velocity. As in the case of an inorganic powder, a high critical current density is attained by increasing the flow velocity. These relations will be manifest from Tables 23 and 24.

Table 23

Relation between flow velocity and current efficiency (current density 20 A/dm²)

| | | |
|---|---|---|
| Flow velocity (cm/sec) | 0.80 | 2.0 |
| Current efficiency (%) | 99 | 100 |

Table 24

Relation between critical current density and flow velocity (current efficiency 100%)

| | | | |
|---|---|---|---|
| Critical current density (A/dm²) | 20 | 25 | 30 |
| Flow velocity (cm/sec) | >2.0 | >3.1 | >4.5 |

(ii) Hardness and Latex Content of Composite-Plated Coating

The hardness and latex content of the composite-plated coating remain unaffected by changes of the current density. The relation will be seen from Table 25.

Table 25

Hardness and latex content of composite-plated coating (flow velocity 4.5 cm/sec)

| | | | |
|---|---|---|---|
| Current density (A/dm²) | 20 | 25 | 30 |
| Latex content of plated coating (%) | 1.9 | 1.8 | 1.8 |
| Hardness (MHv 0.2) | 503 | 508 | 505 |

Example of Composite Plating with Matrixes Other than Nickel

Examples of composite plating with plating baths based on metals other than nickel, namely, copper, zinc, and tin, will now be given. To summarize the results, the following tendencies are observed in common with the individual plating operations, although the critical current density ranges vary.

If the flow velocity is raised, the critical current density will increase.

A high current density tends to increase the silicon carbide content and hardness of the resulting plated coating.

In any case, the powder to be separately and dispersedly precipitated was of silicon carbide, with a particle size of 0.5 – 3 μ. The powder was used in a concentration of 150 grams per liter of each plating bath.

(13) Copper-Based Composite Plating

The composition of the plating solution and the plating conditions used were as follows:

Composition : Copper sulfate 220 ± 20 g/l; Sulfuric acid 47 ± 17 g/l
Plating temperature : 30° ± 5° C
Flow velocity : 0.1 – 400 cm/sec
Current density : 1 – 90 A/dm²

The relation between the flow velocity and critical current density and the relation between the current density and the silicon carbide content and hardness of the plated coating are shown in Tables 26 and 27.

Table 26

Relation between critical current density and flow velocity

| | | | |
|---|---|---|---|
| Critical current density (A/dm²) | 10 | 20 | 30 |
| Flow velocity (cm/sec) | >5 | >20 | >45 |

Table 27

SiC content and hardness of composite-plated coating

| | | | |
|---|---|---|---|
| Current density (A/dm²) | 10 | 20 | 30 |
| SiC content of plated coating (%) | 3.3 | 3.5 | 3.6 |
| Hardness (MHv 0.2) | 306 | 318 | 325 |

(14) Zinc-Based Composite Plating

The composition of the plating solution and the plating conditions used were as follows:

| | | |
|---|---|---|
| Composition: | Zinc sulfate | 240 g/l |
| | Ammonium chloride | 15 g/l |
| | Aluminum sulfate | 30 g/l |
| | Sodium acetate | 15 g/l |
| | Glucose | 120 g/l |
| Plating temperature: | 25 ± 5° C | |
| Flow velocity: | 0.1 – 500 cm/sec | |
| Current: | 1 – 70 A/dm² | |

The relation between the flow velocity and critical current density and the relation between the current density and the silicon carbide content and hardness of the plated coating are given in Tables 28 and 29.

Table 28

Relation between critical current density and flow velocity

| | | | |
|---|---|---|---|
| Critical current density (A/dm²) | 5 | 10 | 15 |
| Flow velocity (cm/sec) | >2.5 | >11 | >25 |

Table 29

SiC content and hardness of plated coating

| | | | |
|---|---|---|---|
| Current density (A/dm²) | 5 | 10 | 15 |
| SiC content of plated coating (%) | 2.6 | 2.8 | 3.0 |
| Hardness (MHv 0.2) | 132 | 148 | 150 |

(15) Tin-Based Composite Plating

The composition of the plating solution and the plating conditions used were as follows:

| | | |
|---|---|---|
| Composition: | Stannous sulfate | 5050/g/l |
| | Sulfuric acid | 110100 g/l |
| | Cresol-sulfonic acid | 100 g/l |
| | β-Naphthol | 1 g/l |
| | Celatin | 2 g/l |
| Plating temperature: | 25 ± 5° C | |
| Flow velocity: | 0.3 – 600 cm/sec | |
| Current density: | 1 – 50 A/dm² | |

The relation between the flow velocity and critical current density and the relation between the current density and the silicon carbide content and hardness of the plated coating were as tabulated in Tables 30 and 31.

Table 30

| Relation between critical current density and flow velocity | | | |
|---|---|---|---|
| Critical current density ($A/dm^2$) | 5 | 10 | 15 |
| Flow velocity (cm/sec) | >10 | >38 | >83 |

Table 31

| Relation between SiC content and hardness of plated coating | | | |
|---|---|---|---|
| Current density ($A/dm^2$) | 5 | 10 | 15 |
| SiC content of plated coating (%) | 2.7 | 2.9 | 3.1 |
| Hardness (MHv 0.2) | 51 | 53 | 59 |

The powder-dispersed composite-plating apparatus according to the present invention offers the following advantages:

(i) For conventional tank-type plating processes the agitation of the plating bath with bubbles of air blown in and/or vibration or rocking of the object to be plated is indispensable. The present invention eliminates all the labor involved in such steps. Because it requires only a recycling pump for the plating solution, the invention realizes a great saving in labor.

(ii) With a sulfamic acid bath ($Ni(NH_2SO_3)_2 \cdot 4H_2O$) the maximum current density practically employable for the ordinary tank-type plating processes is 20 $A/dm^2$. Under the invention, current densities of more than 20 $A/dm^2$ can be used by increasing the flow velocity of the plating solution. Hence the plating time is shortened.

(III) The flow velocity of the plating solution being equal, the hardness of the composite-plated coating can be adjusted through the control of the current density. In order words, the higher the current density, the harder the resulting plated coating will become because of an increased silicon carbide content of the plating.

(iv) With an increase in the flow velocity of the plating solution, the cathode current efficiency can be improved.

(v) The use of a high current density brings a large content of fine hard particles, such as of silicon carbide, formed as separate and dispersed precipitate in the composite-plated coating. Moreover, the fine hard particles are all the more thoroughly dispersed.

(vi) As already pointed out, the characteristics of the composite-plated coating formed in conformity with the present invention are not in the least inferior to those of the coatings formed conventionally with ordinary plating tanks.

What is claimed is:

1. A process for high speed plating of an object with a composite plating of a plating metal and a pulverulent material comprising the steps of providing a composite plating solution containing pulverulent material, applying a current density to said object of at least about 15 $A/dm^2$, and causing a portion of said composite plating solution including substantially all said pulverulent material in said portion to flow in an upward direction at a velocity which is at least about 4.2 cm/sec past the portion of said object which is to be plated.

2. A process as set forth in claim 1 including the step of substantially uniformly dispersing the pulverulent material in the portion of said plating solution flowing past the portion of said object to be plated during said upward flow.

3. A process as set forth in claim 2 wherein said step of substantially uniformly dispersing said pulverulent material in said plating solution comprises the step of passing said plating solution containing said pulverulent material through a screen.

4. A process as set forth in claim 3 including the steps of placing said object in a tank having an inlet for said composite plating solution below said object and having an outlet above said object, and positioning said screen between said inlet and said object.

5. A process as set forth in claim 4 wherein said screen has a mesh size of between about 0.1 and 1.1 cm.

6. A process as set forth in claim 2 wherein said plating metal is nickel and wherein said pulverulent material is selected from the group of silicon carbide, tungsten carbide, aluminum oxide, titanium dioxide, titanium carbide, molybdenum disulfide, carbon fluoride or butadiene styrene rubber.

7. A process as set forth in claim 1 wherein said flow velocity is between about 4.2 and 400 cm/sec and said current density is between about 15 and 300 $A/dm^2$.

8. A process as set forth in claim 7 including the step of substantially uniformly dispersing the pulverulent material in the portion of said plating solution flowing past the portion of said object to be plated during said upward flow.

9. A process as set forth in claim 8 wherein said step of substantially uniformly dispersing said pulverulent material in said plating solution comprises the step of passing said plating solution containing said pulverulent material through a screen.

10. A process as set forth in claim 8 wherein said plating metal is nickel and wherein said pulverulent material is selected from the group of silicon carbide, tungsten carbide, aluminum oxide, titanium dioxide, titanium carbide, molybdenum disulfide, carbon fluoride or butadiene styrene rubber.

11. A process as set forth in claim 1 wherein said flow velocity is greater than about 9.0 cm/sec and said current density is greater than about 30 $A/dm^2$.

12. A process as set forth in claim 11 including the step of substantially uniformly dispersing the pulverulent material in the portion of said plating solution flowing past the portion of said object to be plated during said upward flow.

13. A process as set forth in claim 12 wherein said step of substantially uniformly dispersing said pulverulent material in said plating solution comprises the step of passing said plating solution containing said pulverulent material through a screen.

14. A process as set forth in claim 9 wherein said plating metal is provided at an anode and wherein said object to be plated comprises a cathode and wherein the spacing between said anode and cathode is between about 0.2 cm and 10.0 cm.

15. A process as set forth in claim 1 wherein said flow velocity is between about 4.2 and 1,000 cm/sec and wherein said current density is between about 15 and 300 $A/dm^2$.

16. A process as set forth in claim 15 including the step of substantially uniformly dispersing the pulverulent material in the portion of said plating solution flowing past the portion of said object to be plated during said upward flow.

17. A process as set forth in claim 16 wherein said step of substantially uniformly dispersing said pulverulent material in said plating solution comprises the step of passing said plating solution containing said pulverulent material through a screen.

18. A process as set forth in claim 15 wherein said plating metal is provided at an anode and wherein said object to be plated comprises a cathode and wherein the spacing between said anode and cathode is between about 0.2 cm and 10.0 cm.

19. A process as set forth in claim 18 wherein said plating metal is nickel and said pulverulent material is selected from the group of silicon carbide, tungsten carbide, aluminum oxide, titanium dioxide, titanium carbide, molybdenum disulfide, carbon fluoride, or butadiene styrene rubber.

20. A process as set forth in claim 1 wherein said flow velocity is any amount up to about 600 cm/sec.

21. A process as set forth in claim 20 including the step of substantially uniformly dispersing the pulverulent material in the portion of said plating solution flowing past the portion of said object to be plated during said upward flow.

22. A process as set forth in claim 21 wherein said step of substantially uniformly dispersing said pulverulent material in said plating solution comprises the step of passing said plating solution containing said pulverulent material through a screen.

23. A process as set forth in claim 20 wherein said current density is any amount up to about 300 A/dm$^2$.

24. A process as set forth in claim 23 wherein said flow velocity is at least greater than about 9.0 cm/sec and said current density is at least 30 A/dm$^2$.

25. A process as set forth in claim 24 wherein said plating metal is provided at an anode and wherein said object to be plated comprises a cathode and wherein the spacing between said anode and cathode is between about 0.2 cm and 10.0 cm.

26. A process as set forth in claim 1 wherein said flow velocity is any amount up to about 300 cm/sec.

27. A process as set forth in claim 26 including the step of substantially uniformly dispersing the pulverulent material in the portion of said plating solution flowing past the portion of said object to be plated during said upward flow.

28. A process as set forth in claim 27 wherein said step of substantially uniformly dispersing said pulverulent material in said plating solution comprises the step of passing said plating solution containing said pulverulent material through a screen.

29. A process as set forth in claim 27 wherein said plating nickel is nickel and wherein said pulverulent material is selected from the group of silicon carbide, tungsten carbide, aluminum oxide, titanium dioxide, titanium carbide, molybdenum disulfide, carbon fluoride or butadiene styrene rubber.

30. A process as set forth in claim 26 wherein said current density is any amount up to about 200 A/dm$^2$.

31. A process as set forth in claim 30 wherein said flow velocity is at least greater than about 9.0 cm/sec and said current density is at least about 30 A/dm$^2$.

32. A process as set forth in claim 1 wherein said flow velocity is at least about 15.6 cm/sec.

33. A process as set forth in claim 32 including the step of substantially uniformly dispersing the pulverulent material in the portion of said plating solution flowing past the portion of said object to be plated during said upward flow.

34. A process as set forth in claim 32 wherein said step of substantially uniformly dispersing said pulverulent material in said plating solution comprises the step of passing said plating solution containing said pulverulent material through a screen.

35. A process as set forth in claim 32 wherein said current density is any amount up to about 300 A/dm$^2$.

36. A process as set forth in claim 35 wherein said current density is at least about 30 A/dm$^2$.

37. A process as set forth in claim 1 wherein said flow velocity is at least greater than about 32 cm/sec.

38. A process as set forth in claim 37 including the step of substantially uniformly dispersing the pulverulent material in the portion of said plating solution flowing past the portion of said object to be plated during said upward flow.

39. A process as set forth in claim 38 wherein said step of substantially uniformly dispersing said pulverulent material in said plating solution comprises the step of passing said plating solution containing said pulverulent material through a screen.

40. A process as set forth in claim 37 wherein said current density is any amount up to about 300 A/dm$^2$.

41. A process as set forth in claim 37 wherein said current density is at least about 25 A/dm$^2$.

42. A process as set forth in claim 1 wherein said flow velocity is any amount up to about 300 cm/sec and wherein said current density is any amount up to about 300 A/dm$^2$.

43. A process as set forth in claim 42 including the step of substantially uniformly dispersing the pulverulent material in the portion of said plating solution flowing past the portion of said object to be plated during said upward flow.

44. A process as set forth in claim 43 wherein said step of substantially uniformly dispersing said pulverulent material in said plating solution comprises the step of passing said plating solution containing said pulverulent material through a screen.

45. A process as set forth in claim 43 wherein said plating metal is nickel and wherein said pulverulent material is selected from the group of silicon carbide, tungsten carbide, aluminum oxide, titanium dioxide, titanium carbide, molybdenum disulfide, carbon fluoride or butadiene styrene rubber.

46. A process as set forth in claim 42 wherein said flow velocity is at least greater than about 9.0 cm/sec and said current density is at least about 30 A/dm$^2$.

47. A process as set forth in claim 1 wherein said current density is any amount up to about 90 A/dm$^2$.

48. A process as set forth in claim 47 including the step of substantially uniformly dispersing the pulverulent material in the portion of said plating solution flowing past the portion of said object to be plated during said upward flow.

49. A process as set forth in claim 48 wherein said step of substantially uniformly dispersing said pulverulent material in said plating solution comprises the step of passing said plating solution containing said pulverulent material through a screen.

50. A process as set forth in claim 47 wherein said flow velocity is any amount up to about 400 cm/sec.

51. A process as set forth in claim 1 wherein said flow velocity is any amount up to about 10 and 200 cm/sec.

52. A process as set forth in claim 51 including the step of substantially uniformly dispersing the pulverulent material in the portion of said plating solution flowing past the portion of said object to be plated during said upward flow.

53. A process as set forth in claim 52 wherein said step of substantially uniformly dispersing said pulverulent material in said plating solution comprises the step of passing said plating solution containing said pulverulent material through a screen.

54. A process as set forth in claim 51 wherein said current density is any amount between about 20 A/dm$^2$ and 300 A/dm$^2$.

55. A process as set forth in claim 54 wherein said flow velocity is greater than at least about 13.5 cm/sec and said current density is greater than at least 20 A/dm$^2$.

56. A process as set forth in claim 1 wherein said flow velocity is any amount up to about 500 cm/sec.

57. A process as set forth in claim 56 including the step of substantially uniformly dispersing the pulverulent material in the portion of said plating solution flowing past the portion of said object to be plated during said upward flow.

58. A process as set forth in claim 57 wherein said step of substantially uniformly dispersing said pulverulent material in said plating solution comprises the step of passing said plating solution containing said pulverulent material through a screen.

59. A process as set forth in claim 56 wherein said current density is any amount up to about 300 A/dm$^2$.

60. A process as set forth in claim 59 wherein said flow velocity is at least greater than about 9.0 cm/sec and said current density is at least about 30 A/dm$^2$.

61. A process as set forth in claim 1 wherein said flow velocity is between about 20 and 300 cm/sec and wherein said current density is between about 20 and 300 A/dm$^2$.

62. A process as set forth in claim 61 including the step of substantially uniformly dispersing the pulverulent material in the portion of said plating solution flowing past the portion of said object to be plated during said upward flow.

63. A process as set forth in claim 62 wherein said step of substantially uniformly dispersing said pulverulent material in said plating solution comprises the step of passing said plating solution containing said pulverulent material through a screen.

64. A process as set forth in claim 61 wherein said plating metal is provided at an anode and wherein said object to be plated comprises a cathode and wherein the spacing between said anode and cathode is between about 0.2 cm and 10.0 cm.

65. A process as set forth in claim 1 wherein said current density is any amount up to about 200 A/dm$^2$.

66. A process as set forth in claim 65 including the step of substantially uniformly dispersing the pulverulent material in the plating solution flowing past the portion of said object to be plated during said upward flow.

67. A process as set forth in claim 66 wherein said step of substantially uniformly dispersing said pulverulent material in said portion of said plating solution comprises the step of passing said plating solution containing said pulverulent material through a screen.

68. A process as set forth in claim 65 wherein said flow velocity is at least about 6.0 cm/sec.

69. A process as set forth in claim 1 wherein said flow velocity is between about 9.0 and 400 cm/sec and wherein said current density is between about 30 and 200 A/dm$^2$.

70. A process as set forth in claim 69 including the step of substantially uniformly dispersing the pulverulent material in the plating solution flowing past the portion of said object to be plated during said upward flow.

71. A process as set forth in claim 70 wherein said step of substantially uniformly dispersing said pulverulent material in said plating solution comprises the step of passing said plating solution containing said pulverulent material through a screen.

72. A process as set forth in claim 70 wherein said plating metal is nickel and wherein said pulverulent material is selected from the group of silicon carbide, tungsten carbide, aluminum oxide, titanium dioxide, titanium carbide, molybdenum disulfide, carbon fluoride or butadiene styrene rubber.

73. A process as set forth in claim 69 wherein said plating metal is provided at an anode and wherein said object to be plated comprises a cathode and wherein the spacing between said anode and cathode is between about 0.2 cm and 10.0 cm.

74. A process as set forth in claim 1 wherein said flow velocity is between about 9.0 and 1,000 cm/sec and wherein said current density is between about 30 A/dm$^2$ and 300 A/dm$^2$.

75. A process as set forth in claim 74 wherein said plating metal is provided at an anode and wherein said object to be plated comprises a cathode and wherein the spacing between said anode and cathode is between about 0.2 cm and 10.0 cm.

76. A process as set forth in claim 1 wherein said plating metal is provided at an anode and wherein said object to be plated comprises a cathode and wherein the spacing between said anode and cathode is between about 0.2 cm and 10.0 cm.

77. A process for plating an object with a composite plating of a plating metal and a pulverulent material comprising the steps of causing said object to be a cathode, providing a composite plating solution containing pulverulent material, causing a portion of said composite plating solution including substantially all said pulverulent material in said portion to flow past said object at a flow velocity of at least about 4.2 cm/sec so as to maintain a predetermined current efficiency to effect said composite plating, and adjusting the current density to a predetermined amount between about 5 A/dm$^2$ and an amount in excess of 5 A/dm$^2$ to adjust the content of the pulverulent material in the composite plating to a predetermined amount.

78. A process as set forth in claim 77 wherein the flow of said composite plating solution in upward.

79. A process as set forth in claim 77 wherein said plating metal is nickel and wherein said pulverulent material is selected from the group of silicon carbide, tungsten carbide, aluminum oxide, or titanium carbide.

80. A process as set forth in claim 77 wherein said pulverulent material is silicon carbide and wherein said plating metal is selected from the group of nickel, copper, zinc or tin.

81. A process as set forth in claim 80 wherein said current density is between about 5 and 30 A/dm$^2$ and wherein said flow velocity is between about 4.2 and 83 cm/sec.

82. A process as set forth in claim 81 wherein said plating metal is provided at an anode and wherein the spacing between the anode and cathode is between about 0.2 cm and 10.0 cm.

83. A process as set forth in claim 77 wherein said plating metal is nickel and wherein said pulverulent material is silicon carbide and wherein said current density is between about 15 A/dm² and 70 A/dm² and wherein said content of said pulverulent material in the plating is between about 3.0 percent and 5.0 percent.

84. A process as set forth in claim 83 wherein said plating metal is provided at an anode and wherein the spacing between the anode and cathode is between about 0.2 cm and 10.0 cm.

85. A process as set forth in claim 77 wherein said plating metal is nickel and said pulverulent material is silicon carbide and wherein said flow velocity is about 4.2 cm/sec and said current density is between about 15 and 30 A/dm².

86. A process as set forth in claim 85 wherein the content of said silicon carbide is adjusted to between about 3.0% and 4.0%.

87. A process as set forth in claim 77 wherein said plating metal is nickel and said pulverulent material is silicon carbide and wherein the content of said silicon carbide is adjusted to between about 3.0% and 5.0%.

88. A process as set forth in claim 77 wherein said plating metal is nickel and said pulverulent material is tungsten carbide and wherein said flow velocity is greater than about 45 cm/sec and wherein said current density is between 20 and 30 A/dm².

89. A process as set forth in claim 77 wherein said plating metal is nickel and said pulverulent material is tungsten carbide and wherein the content of said tungsten carbide is adjusted to between about 3.8% and 4.1%.

90. A process as set forth in claim 89 wherein said flow velocity is about 45 cm/sec and wherein said current density is between 20 and 30 A/dm².

91. A process as set forth in claim 77 wherein said plating metal is nickel and said pulverulent material is aluminum oxide and wherein said flow velocity is about 13.5 cm/sec and wherein said current density is between about 20 and 30 A/dm².

92. A process as set forth in claim 77 wherein said plating metal is nickel and said pulverulent material is aluminum oxide and wherein the content of said aluminum oxide is adjusted to between about 4.8% and 5.3%.

93. A process as set forth in claim 92 wherein said flow velocity is about 13.5 cm/sec and wherein said current density is between about 20 and 30 A/dm².

94. A process as set forth in claim 77 wherein said plating metal is nickel and said pulverulent material is titanium carbide and wherein sid flow velocity is about 15.6 cm/sec and said current density is between about 20 and 30 A/dm².

95. A process as set forth in claim 77 wherein said plating metal is nickel and said pulverulent material is molybdenum disulfide and wherein the content of said molybdenum disulfide is adjusted to between about 3.2% and 3.5%.

96. A process as set forth in claim 95 wherein said flow velocity is about 15.6 cm/sec and said current density is between about 20 and 30 A/dm².

97. A process as set forth in claim 77 wherein said plating metal is copper and said pulverulent material is silicon carbide and said flow velocity is greater than about 45 cm/sec and said current density is between about 10 and 30 A/dm².

98. A process as set forth in claim 77 wherein said plating metal is copper and said pulverulent material is silicon carbide and wherein the content of said silicon carbide is adjusted to between about 3.3% and 3.6%.

99. A process as set forth in claim 98 wherein said flow velocity is greater than about 45 cm/sec and said current density is between about 10 and 30 A/dm².

100. A process as set forth in claim 77 wherein said plating metal is zinc and said pulverulent material is silicon carbide and wherein said flow velocity is greater than about 25 cm/sec and wherein said current density is between about 5 and 15 A/dm².

101. A process as set forth in claim 77 wherein said plating metal is zinc and said pulverulent material is silicon carbide and the content of said silicon carbide is adjusted to between about 2.6% and 3.0%.

102. A process as set forth in claim 101 wherein said flow velocity is greater than about 25 cm/sec and wherein said current density is between about 5 and 15 A/dm².

103. A process as set forth in claim 77 wherein said plating metal is tin and said pulverulent material is silicon carbide and wherein said flow velocity is greater than about 10 cm/sec and wherein said current density is between about 5 and 15 A/dm².

104. A process as set forth in claim 77 wherein said plating metal is tin and said pulverulent material is silicon carbide and the content of said silicon carbide is adjusted to between about 2.7 and 3.1%.

105. A process as set forth in claim 104 wherein said flow velocity is greater than about 10 cm/sec and wherein said current density is between about 5 and 15 A/dm².

106. A process as set forth in claim 77 wherein said plating metal is nickel and said pulverulent material is titanium carbide and wherein the content of said titanium carbide is adjusted to between about 3.6% and 4.2%.

107. A process as set forth in claim 106 wherein said flow velocity is about 15.6 cm/sec and said current density is between about 20 and 30 A/dm².

108. A process as set forth in claim 77 wherein said plating metal is provided at an anode and wherein the spacing between the anode and the cathode is between about 0.2 cm and 10.0 cm.

109. A process as set forth in claim 36 wherein said plating metal is provided at an anode and wherein said object to be plated comprises a cathode and wherein the spacing between said anode and cathode is between about 0.2 cm and 10.0 cm.

110. A process for high speed plating of an object with a composite plating of a plating metal and a pulverulent material comprising the steps of providing a composite plating solution containing pulverulent material, applying a current density to said object of at least about 15 A/dm², and causing a portion of said composite plating solution including substantially all said pulverulent material in said portion to flow at a velocity which is at least about 4.2 cm/sec past the portion of said object which is to be plated with a composite plating.

111. A process as set forth in claim 110 wherein said velocity is between about 4.2 cm/sec and 400 cm/sec and wherein said current density is between about 15 A/dm² and 300 A/dm².

112. A process as set forth in claim 111 wherein aid plating metal comprises the anode and wherein said object to be plated comprises the cathode and wherein the spacing between said anode and cathode is between about 0.2 cm and 10.0 cm.

113. A process as set forth in claim 111 wherein said plating metal is nickel and wherein said pulverulent material is silicon carbide.

114. A process as set forth in claim 113 wherein said plating metal comprises an anode and wherein said object comprises a cathode and wherein the spacing between said anode and said cathode is between about 0.2 cm and 10.0 cm.

115. A process as set forth in claim 110 wherein said velocity is greater than about 6.5 cm/sec.

116. A process as set forth in claim 110 wherein said velocity is greater than about 9.0 cm/sec.

117. A process as set forth in claim 116 wherein said plating metal comprises the anode and wherein said object to be plated comprises the cathode and wherein the spacing between said anode and cathode is between about 0.2 cm and 10.0 cm.

118. A process as set forth in claim 110 wherein said velocity is greater than about 13.5 cm/sec.

119. A process as set forth in claim 118 wherein said plating metal comprises the anode and wherein said object to be plated comprises the cathode and wherein the spacing between said anode and cathode is between about 0.2 cm and 10.0 cm.

120. A process as set forth in claim 110 wherein said velocity is greater than about 21.8 cm/sec.

121. A process as set forth in claim 120 wherein said plating metal comprises the anode and wherein said object to be plated comprises the cathode and wherein the spacing between said anode and cathode is between about 0.2 cm and 10.0 cm.

122. A process as set forth in claim 110 wherein said velocity is greater than about 32 cm/sec.

123. A process as set forth in claim 122 wherein said plating metal comprises the anode and wherein said object to be plated comprises the cathode and wherein the spacing between said anode and cathode is between about 0.2 and 10.0 cm.

124. A process as set forth in claim 110 wherein said velocity is greater than about 45.0 cm/sec.

125. A process as set forth in claim 124 wherein said plating comprises the anode and wherein said object to be plated comprises the cathode and wherein the spacing between said anode and cathode is between about 0.2 cm and 10.0 cm.

126. A process as set forth in claim 110 wherein said velocity is greater than about 83 cm/sec.

127. A process as set forth in claim 126 wherein said plating metal comprises the anode and wherein said object to be plated comprises the cathode and wherein the spacing between said anode and cathode is between about 0.2 cm and 10.0 cm.

128. A process as set forth in claim 110 wherein said velocity is between about 7 cm/sec and 500 cm/sec.

129. A process as set forth in claim 128 wherein said flow is upwardly.

130. A process as set forth in claim 129 wherein said plating metal comprises the anode and wherein said object to be plated comprises the cathode and wherein the spacing between said anode and cathode is between about 0.2 cm and 10.0 cm.

131. A process as set forth in claim 110 wherein said velocity is between about 15 cm/sec and 500 cm/sec.

132. A process as set forth in claim 131 wherein said current density is between about 20 A/dm$^2$ and 300 A/dm$^2$.

133. A process as set forth in claim 131 wherein said plating metal comprises the anode and wherein said object to be plated comprises the cathode and wherein the spacing between the anode and cathode is between about 0.2 cm and 10.0 cm.

134. A process as set forth in claim 133 including the step of substantially uniformly dispersing the pulverulent material in the plating solution flowing past the portion of said object to be plated.

135. A process as set forth in claim 131 wherein said flow is upwardly.

136. A process as set forth in claim 110 wherein said velocity is any value up to about 1,000 cm/sec and wherein said current density is between about 20 A/dm$^2$ and 300 A/dm$^2$.

137. A process as set forth in claim 110 wherein said plating metal is nickel and said pulverulent material is silicon carbide and wherein said flow velocity is any amount which is greater than about 9.0 cm/sec and up to about 400 cm/sec and wherein the current density is between about 30 A/dm$^2$ and 300 A/dm$^2$.

138. A process as set forth in claim 110 wherein said plating metal is nickel and said pulverulent material is silicon carbide and wherein said flow velocity is between any amount which is greater than about 9.0 cm/sec and up to about 60 cm/sec and wherein said current density is between about 30 A/dm$^2$ and 70 A/dm$^2$.

139. A process as set forth in claim 110 wherein said plating metal is nickel and said pulverulent material is tungsten carbide and wherein said flow velocity is between about 20 cm/sec and 300 cm/sec.

140. A process as set forth in claim 139 wherein said current density is between about 20 A/dm$^2$ and 300 A/dm$^2$.

141. A process as set forth in claim 139 wherein said flow velocity is in excess of about 45 cm/sec and said current density is in excess of about 30 A/dm$^2$.

142. A process as set forth in claim 110 wherein said plating metal is nickel and said pulverulent material is aluminum oxide and wherein said flow velocity is between about 6 cm/sec and 400 cm/sec.

143. A process as set forth in claim 142 wherein said current density is between about 20 A/dm$^2$ and 300 A/dm$^2$.

144. A process as set forth in claim 142 wherein said flow velocity is at least about 13.5 cm/sec.

145. A process as set forth in claim 142 wherein said flow velocity is at least about 13.5 cm/sec and said current density is at least about 30 A/dm$^2$.

146. A process as set forth in claim 110 wherein said plating metal is nickel and said pulverulent material is titanium dioxide and wherein said flow velocity is any amount up to about 300 cm/sec.

147. A process as set forth in claim 146 wherein said current density is any amount up to about 300 A/dm$^2$.

148. A process as set forth in claim 110 wherein said plating metal is nickel and said pulverulent material is titanium dioxide and wherein said flow velocity is between an amount greater than about 7.5 cm/sec and 300 cm/sec.

149. A process as set forth in claim 148 wherein said current density is between about 30 A/dm$^2$ and 300 A/dm$^2$.

150. A process as set forth in claim 110 wherein said plating metal is nickel and said pulverulent material is titanium carbide and wherein said flow velocity is between about 7 cm/sec and 500 cm/sec.

151. A process as set forth in claim 150 wherein said current density is between about 20 A/dm$^2$ and 300 A/dm$^2$.

152. A process as set forth in claim 110 wherein said plating metal is nickel and said pulverulent material is titanium carbide and wherein said flow velocity is greater than about 11 cm/sec and wherein said current density is at least about 25 A/dm$^2$.

153. A process as set forth in claim 110 wherein said plating metal is nickel and said pulverulent material is titanium carbide and wherein said flow velocity is at least about 15.6 cm/sec.

154. A process as set forth in claim 110 wherein said plating metal is nickel and said pulverulent material is carbon fluoride and said flow velocity is up to about 1,000 cm/sec.

155. A process as set forth in claim 154 wherein said current density is between about 25 A/dm$^2$ and 200 A/dm$^2$.

156. A process as set forth in claim 110 wherein said plating metal is nickel and said pulverulent material is carbon fluoride and wherein said flow velocity is at least about 6 cm/sec and said current density is at least 20 A/dm$^2$.

157. A process as set forth in claim 110 wherein said plating metal is nickel and said pulverulent material is molybdenum disulfide and wherein said flow velocity is between about 7 cm/sec and 400 cm/sec and wherein said current density is between about 20 A/dm$^2$ and 300 A/dm$^2$.

158. A process as set forth in claim 110 wherein said plating metal is nickel and said pulverulent material is molybdenum disulfide and wherein said flow velocity is greater than about 11.5 cm/sec and wherein said current density is at least about 25 A/dm$^2$.

159. A process as set forth in claim 110 wherein said plating metal is nickel and said pulverulent material is butadiene styrene rubber and wherein said flow velocity is between an amount which is greater than about 4.5 cm/sec and 200 cm/sec and wherein said current density is between about 30 A/dm$^2$ and 300 A/dm$^2$.

160. A process as set forth in claim 110 wherein said plating metal is copper and said pulverulent material is silicon carbide and wherein said flow velocity is between about an amount which is greater than 5 cm/sec and 400 cm/sec and wherein said current density is between about 10 A/dm$^2$ and 90 A/dm$^2$.

161. A process as set forth in claim 110 wherein said plating metal is copper and said pulverulent material is silicon carbide and wherein said flow velocity is greater than about 20 cm/sec and wherein said current density is at least about 20 A/dm$^2$.

162. A process as set forth in claim 110 wherein said plating metal is copper and said pulverulent material is silicon carbide and wherein said flow velocity is greater than about 45 cm/sec and wherein aid current density is at least about 30 A/dm$^2$.

163. A process as set forth in claim 110 wherein said plating metal is zinc and said pulverulent material is silicon carbide and wherein said flow velocity is between an amount which is greater than 11 cm/sec and 500 cm/sec and wherein said current density is between about 10 A/dm$^2$ and 70 A/dm$^2$.

164. A process as set forth in claim 110 wherein said plating metal is zinc and said pulverulent material is silicon carbide and wherein said flow velocity is greater than about 25 cm/sec.

165. A process as set forth in claim 110 wherein said plating metal is tin and said pulverulent material is silicon carbide and wherein said flow velocity is up to about 600 cm/sec.

166. A process as set forth in claim 110 wherein said plating metal is tin and said pulverulent material is silicon carbide and wherein said flow velocity is greater than about 38 cm/sec.

167. A process as set forth in claim 110 wherein said plating metal is tin and said pulverulent material is silicon carbide and wherein said flow velocity is up to about 600 cm/sec and wherein said current density is up to about 50 A/dm$^2$.

168. A process as set forth in claim 110 wherein said plating metal is nickel and said pulverulent material is silicon carbide and wherein said current density is between 70 A/dm$^2$ and 300 A/dm$^2$ and wherein said flow velocity is between about 60 cm/sec and 400 cm/sec.

169. A process as set forth in claim 168 wherein said plating metal comprises the anode and said object to be plated comprises the cathode and wherein the spacing between the anode and cathode is between about 0.2 cm and 10.0 cm.

170. A process as set forth in claim 169 wherein said flow is upwardly.

171. A process for high speed plating of an object with a composite plating of a plating metal and a pulverulent material comprising the steps of causing said object to be a cathode, providing composite plating solution containing pulverulent material, causing a portion of said composite plating solution including said pulverulent material in said portion to flow past said object at a velocity of at least about 4.2 cm/sec, providing a current density of at least about 15 A/dm$^2$ to said object to produce a relatively high rate of composite plating, and causing the thickness of the diffusion layer on said object to be reduced with increases in current density above 15 A/dm$^2$ by increasing the flow velocity of, said composite plating solution past said object to a value in excess of said 4.2 cm/sec to permit usage of a current density in excess of said about 15 A/dm$^2$.

172. A process as set forth in claim 171 wherein said current density is increased to any amount between about 30 A/dm$^2$ and 300 A/dm$^2$ and wherein said flow velocity is increased to an amount which is greater than about 9 cm/sec and up to about 1,000 cm/sec.

173. A process as set forth in claim 171 wherein said current density is increased to any value between about 30 A/dm$^2$ and 300 A/dm$^2$ and wherein said velocity is increased to an amount which is greater than about 9 cm/sec and up to about 400 cm/sec.

174. A process as set forth in claim 171 wherein said current density is increased to any value between about 30 A/dm$^2$ and 300 A/dm$^2$ and wherein said velocity is increased to an amount which is greater than about 45 cm/sec and up to about 300 cm/sec.

175. A process as set forth in claim 171 wherein said current density is increased to any value between about 30 A/dm$^2$ and 300 A/dm$^2$ and wherein said velocity is increased to an amount which is greater than about 15.6 cm/sec and up to about 500 cm/sec.

* * * * *

UNITED STATES PATENT AND TRADEMARK OFFICE

CERTIFICATE OF CORRECTION

PATENT NO. : 4,085,010

DATED : April 18, 1978

INVENTOR(S) : Shigeru Ishimori and Shinichi Honda

It is certified that error appears in the above-identified patent and that said Letters Patent are hereby corrected as shown below:

At Column 4, line 5, the equation should read as follows:

$$\delta = 2.91 \times \frac{\left(\frac{\nu x}{u}\right)^{1/2}}{\left(\frac{\nu}{D}\right)^{1/3}}$$

Column 4, line 50, change "sulfonate" to --sulfamate--.
Column 5, line 17, change "uniform" to --ununiform--.

Column 14, line 63, change "Celatin" to --Gelatin--.
Column 15, line 35, change "(III)" to --iii---.
Column 16, line 53, (Claim 14), change "9" to --11--.
Column 17, line 67, (Claim 34), change "32" to --33--.
Column 18, line 63, (Claim 51), cancel "10 and".
Column 20, line 1, (Claim 70), before "plating" insert --portion of said--.
Column 21, line 48, (Claim 94), change "sid" to --said--.
Column 22, line 64, (Claim 112), change "aid" to --said--.
Column 25, line 56, (Claim 162), change "aid" to --said--;
Column 25, line 23, (Claim 156), after "least" insert --about--.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*